US005505474A

United States Patent [19]

Yeh

[11] Patent Number: 5,505,474

[45] Date of Patent: Apr. 9, 1996

[54] FOLDING SKATEBOARD

[76] Inventor: Hsiu-Ying Yeh, 2F. No. 4-1, Alley 7, Lane 133, Chu Kwang Road, Pao-Chiao, Taipei, Taiwan

[21] Appl. No.: 434,714

[22] Filed: May 4, 1995

[51] Int. Cl.[6] ..... A63C 17/00

[52] U.S. Cl. ..... 280/87.042

[58] Field of Search ..... 280/87.042, 87.041, 280/87.05, 652, 39, 11.27, 11.28

[56] References Cited

U.S. PATENT DOCUMENTS

| | | | |
|---|---|---|---|
| 1,483,033 | 2/1924 | Wizman | 280/87.041 |
| 2,986,406 | 5/1961 | Kahl | 280/87.05 |
| 4,076,267 | 2/1978 | Lipscomb | 280/87.042 |
| 4,082,306 | 4/1978 | Sheldon | 280/87.042 |
| 4,955,626 | 9/1990 | Smith et al. | 280/87.042 |
| 5,417,444 | 5/1995 | Chen | 280/87.042 |

FOREIGN PATENT DOCUMENTS

| | | | |
|---|---|---|---|
| 1405865 | 6/1988 | U.S.S.R. | 280/87.041 |

*Primary Examiner*—Richard M. Camby
*Attorney, Agent, or Firm*—Lowe, Price, LeBlanc & Becker

[57] ABSTRACT

A folding skateboard including a plurality of frame bars pivotably connected in series by links, two couplings turned about a respective pivot at two opposite ends of the series of frame bars, two wheel assemblies respectively fastened to the couplings to support the frame bars on the ground, and two foot plates respectively fastened to the couplings above the wheel assemblies for the user to ride by legs.

4 Claims, 7 Drawing Sheets

FOLDING SKATEBOARD

BACKGROUND OF THE INVENTION

The present invention relates to skateboards, and relates more particularly to such a skateboard which is comprised of a plurality of frame bars pivotably connected in series and supported on two opposite wheel assemblies for riding and twisting.

The game of riding a skateboard is popularly accepted by young people because it is suitable for play indoors as well as outdoors. Regular skateboards, as shown in FIG. 1, are generally comprised of a base frame supported on two opposite wheel assemblies, and two foot plates fixed to the two opposite ends of the base frame above the wheel assemblies. Because the foot plates and the wheel assemblies are respectively and securely fixed to the two opposite ends of the base frame, the ankle tends to be hurt when the user twists the leg to control the steering direction of the skateboard. Furthermore, this structure of skateboard provides less variation, therefore it is less challengeable.

SUMMARY OF THE INVENTION

The present invention has been accomplished to provide a folding skateboard which provides much variation for playing in different ways.

According to one aspect of the present invention, the folding skateboard comprises a plurality of frame bars pivotably connected in series by links, two couplings turned about a respective pivot at two opposite ends of the series of frame bars, two wheel assemblies respectively fastened to the couplings to support the frame bars on the ground, and two foot plates respectively fastened to the couplings above the wheel assemblies for the user to ride by legs.

According to another aspect of the present invention, the frame bars each has a plurality of transverse through holes for permitting the frame bars to be closely connected in parallel by inserting respective pins into the transverse through holes on the frame bars.

DETAILED DESCRIPTION OF THE PREFERRED EMBODIMENT

Figure 1:
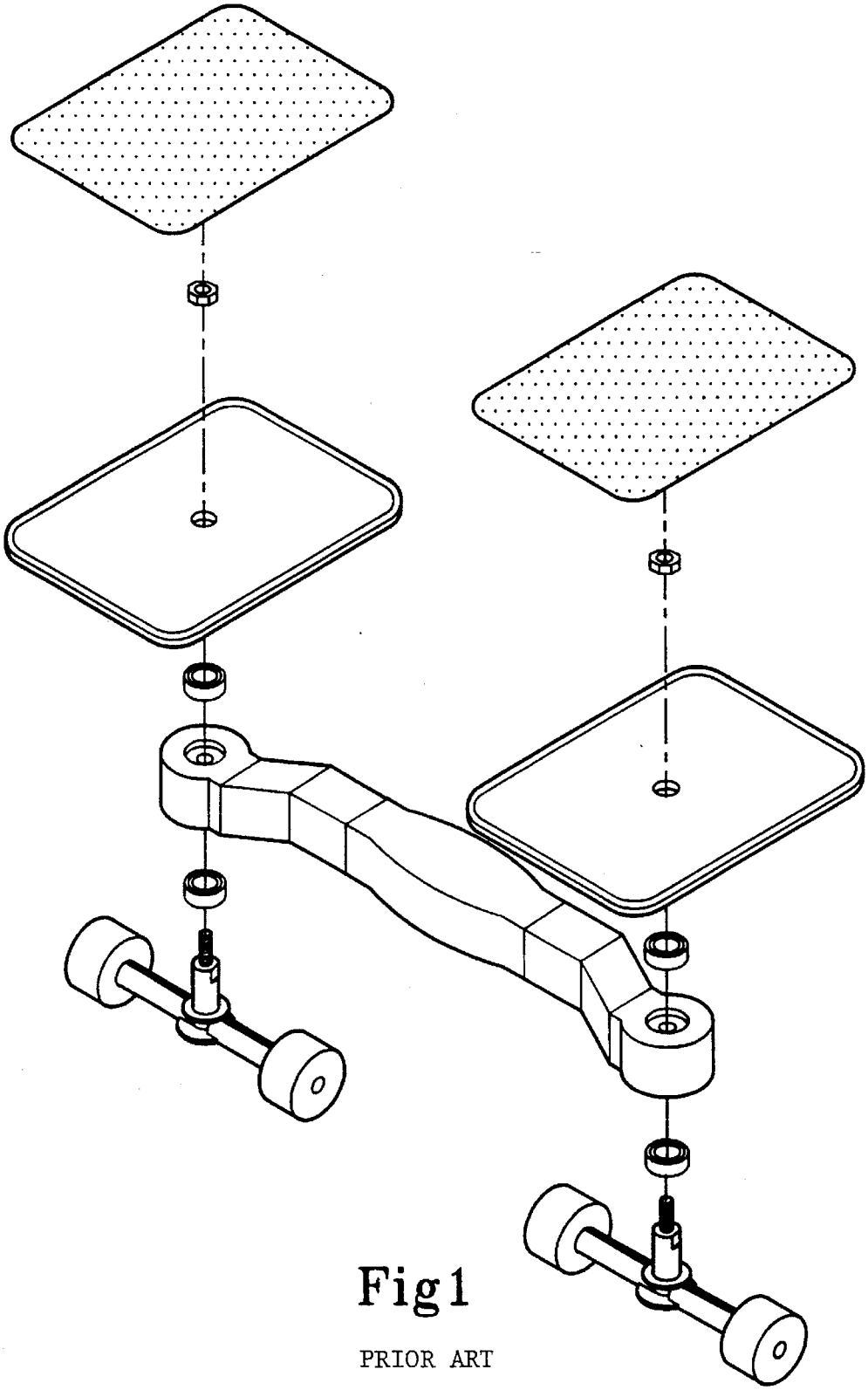
Fig 1 PRIOR ART
FIG. 1 is an exploded view of a skateboard according to the prior art.

Referring to Figures from 2A to 5, a folding skateboard in accordance with the present invention is generally comprised of a plurality of frame bars 1, a plurality of links 2 respectively connected between each two frame bars 1, two couplings 3, two wheel assemblies 5 connected to the frame bars 1 at two opposite ends by the couplings 3, and two foot plates 4 respectively supported on the wheel assemblies 5.

Figures 2A, 2B:
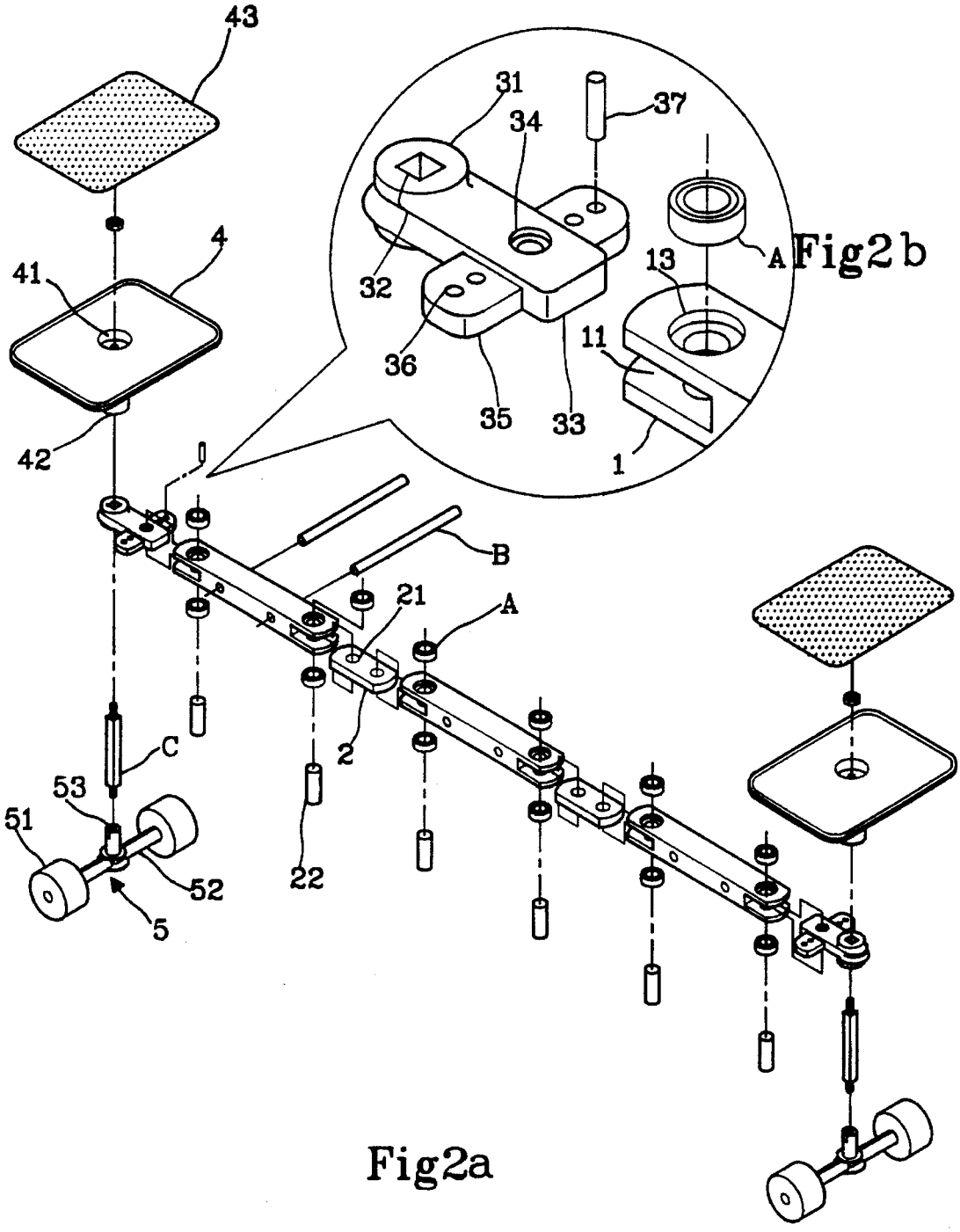
FIG. 2A is an exploded view of a folding skateboard according to the present invention.
FIG. 2B is a partial view in an enlarged scale of the folding skateboard shown in FIG. 2A.
Figure 3:
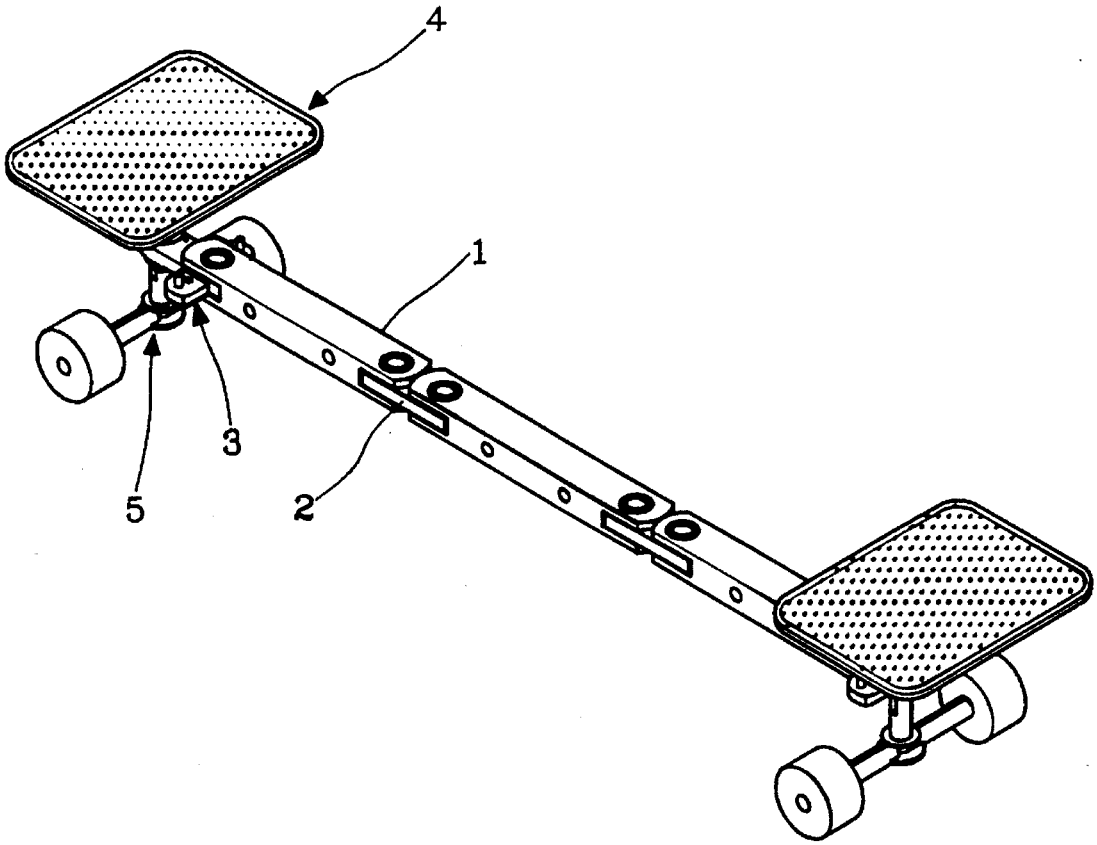
FIG. 3 is an elevational view of the folding skateboard shown in FIG. 2A.
Figure 5:
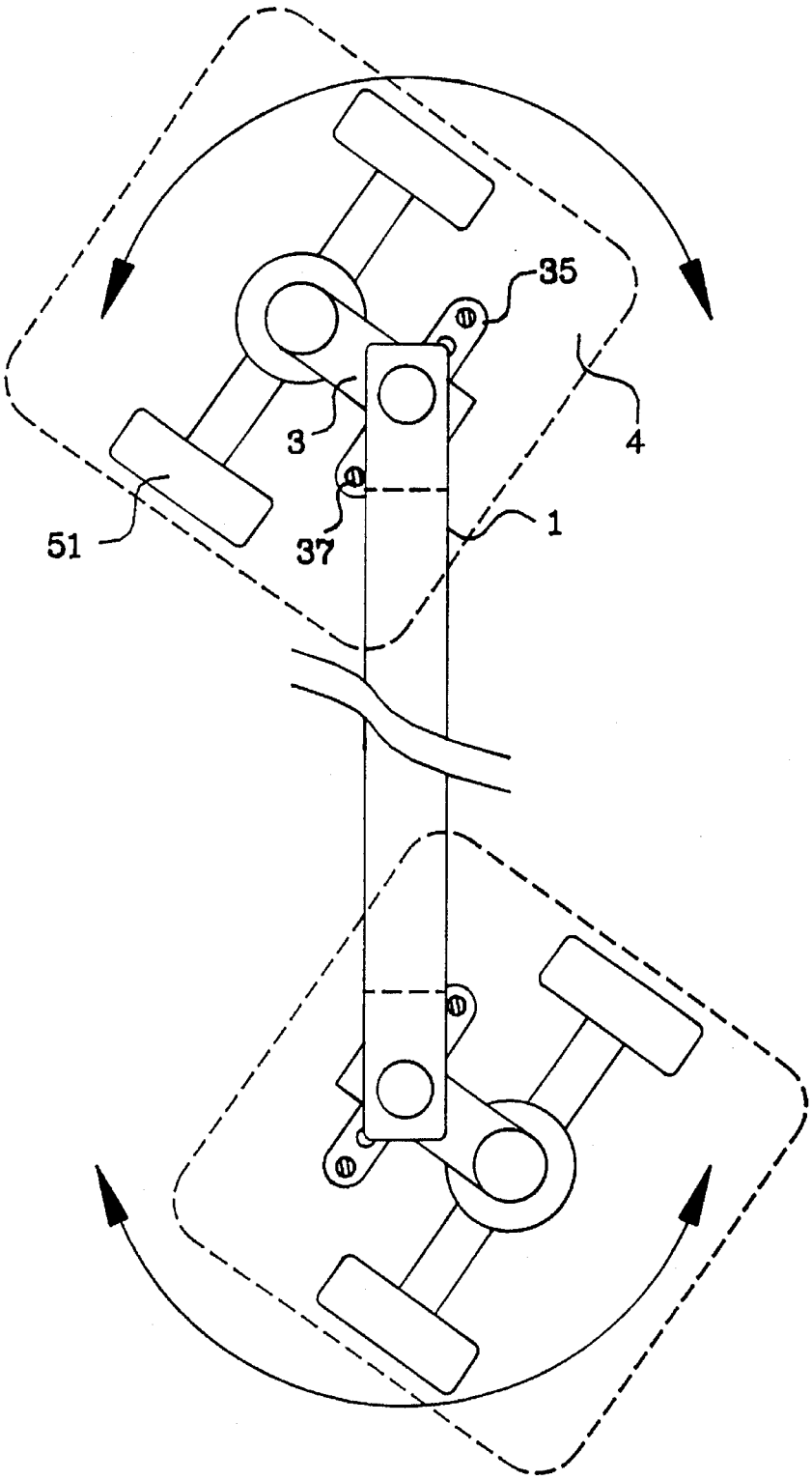
FIG. 5 shows the frame bars of the folding skateboard closely connected in parallel according to the present invention.

Referring to FIGS. 2A, 2B, and 3 again, the frame bar 1 comprises two opposite pairs of vertically spaced bearing blocks 13 at two opposite ends, two longitudinal coupling holes 11 at two opposite ends respectively defined between the pairs of vertically spaced bearing blocks 13, two pairs of axle bearings A respectively mounted within the bearing blocks 13, and a plurality of transverse through holes 12. The link 2 has two circular pivot holes 21 at two opposite ends respectively and pivotably connected between the two axle bearings A at one end of one frame bar 1 by a respective pivot pin 22. Therefore, each frame bar 1 can be turned about the respective pivot pin 22 on the respective link 2. The coupling 3 comprises a vertical barrel 31 at a front end thereof defining a polygonal mounting hole 32 for connection to one wheel assembly 5 by a respective polygonal mounting shaft C, a pivot hole 34 at a rear end thereof pivotably connected between the two axle bearings A at one end of one frame bar 1 by a respective pivot pin 22, two opposite side wings 35 bilaterally extended from the rear end, two rows of holes 36 aligned on the side wings 35, and two pairs of stop rods 37 respectively fastened to the holes 36 on the side wings 35 to limit the turning angle of the respective frame bar 1 (see also FIG. 5). The foot plate 4 is covered with a cushion 43, having a bottom mounting block 42 at the center and a countersunk hole 41 through the bottom mounting block 42 for connection to the barrel 31 of the respective coupling 3 by the respective polygonal mounting shaft C. The wheel assembly 5 comprises a wheel axle 52, two rollers 51 turned about two opposite ends of the wheel axle 52, a female screw 53 raised from the wheel axle 51 in the middle for connection to the barrel 31 of the respective coupling 3 by the respective polygonal mounting shaft C. The polygonal mounting shaft C is inserted through the polygonal mounting hole 31 of the respective coupling 3, having a top threaded end fastened to the countersunk hole 41 on the respective foot plate 4 by a nut and a bottom threaded end screwed up with the female screw 53 on the respective wheel assembly 5.

Figure 4:
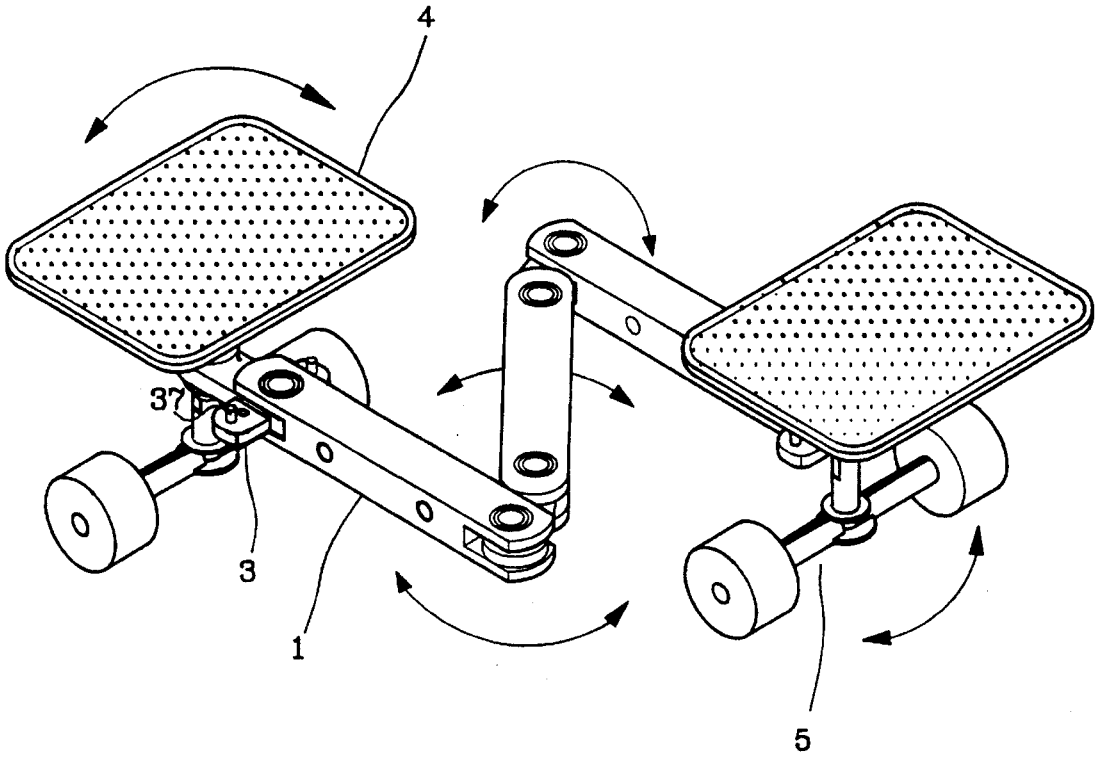
FIG. 4 shows the frame bars of the folding skateboard respectively turned about the respective pivot pin according to the present invention.

Referring to FIGS. 4 and 5 again, because the frame bars 1 and the couplings 3 are pivotably connected in series by the respective links 2 and the respective pivot pins 22, they can be turned about the respective pivot pins 22 when the user twists the foot plates 4 by legs. Furthermore, by changing the positions of the stop rods 37 in the holes 36 on the side wings 35, the turning angles of the two end frame bars 1 relative to the foot plates 4 are respectively adjusted (see FIG. 5).

Figure 6:
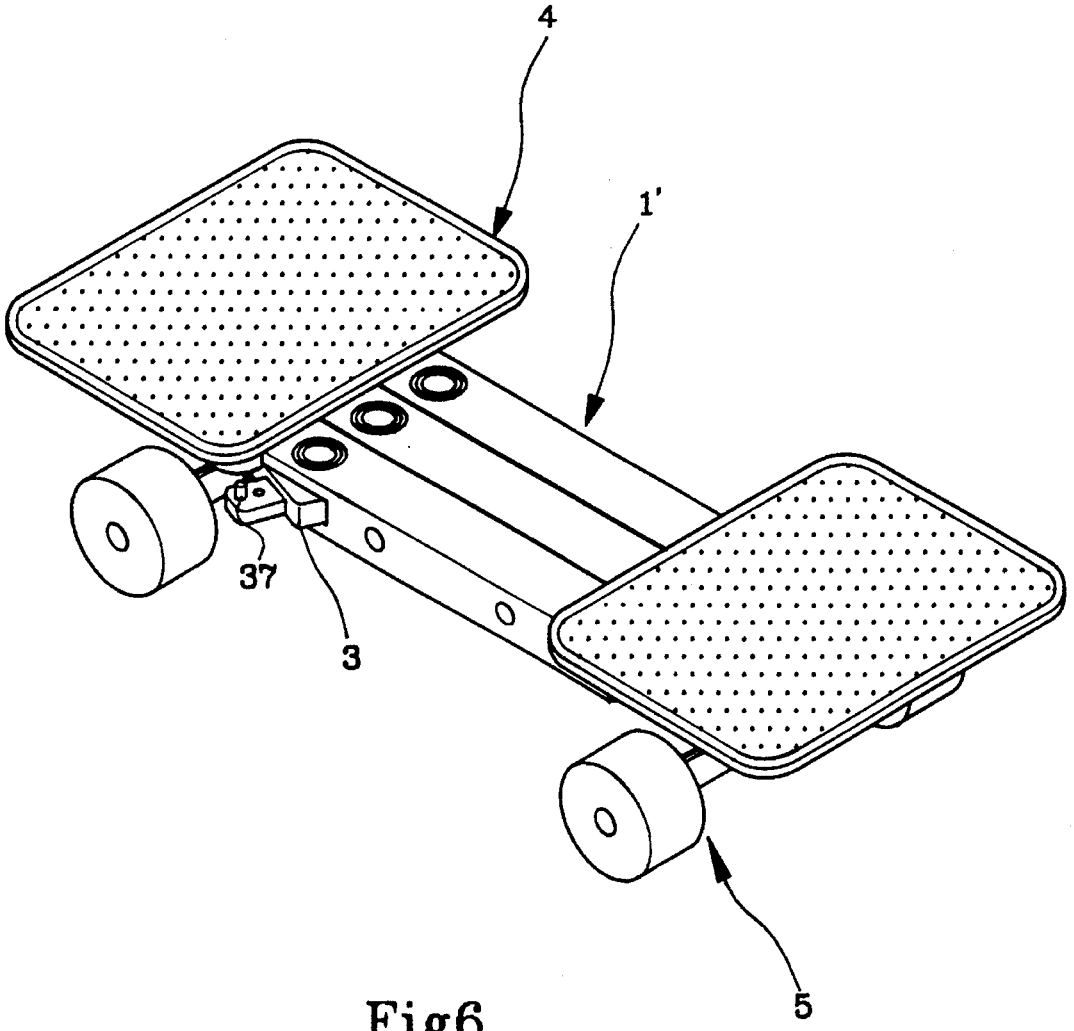
FIG. 6 shows the turning angles of the foot plates relative to the frame bars according to the present invention.

Referring to FIG. 6, the frame bars 1 can be folded up and fastened together to form a combined frame bar 1' by inserting pins B into the respective transverse through holes 12 on the frame bar 1.

Figure 7:
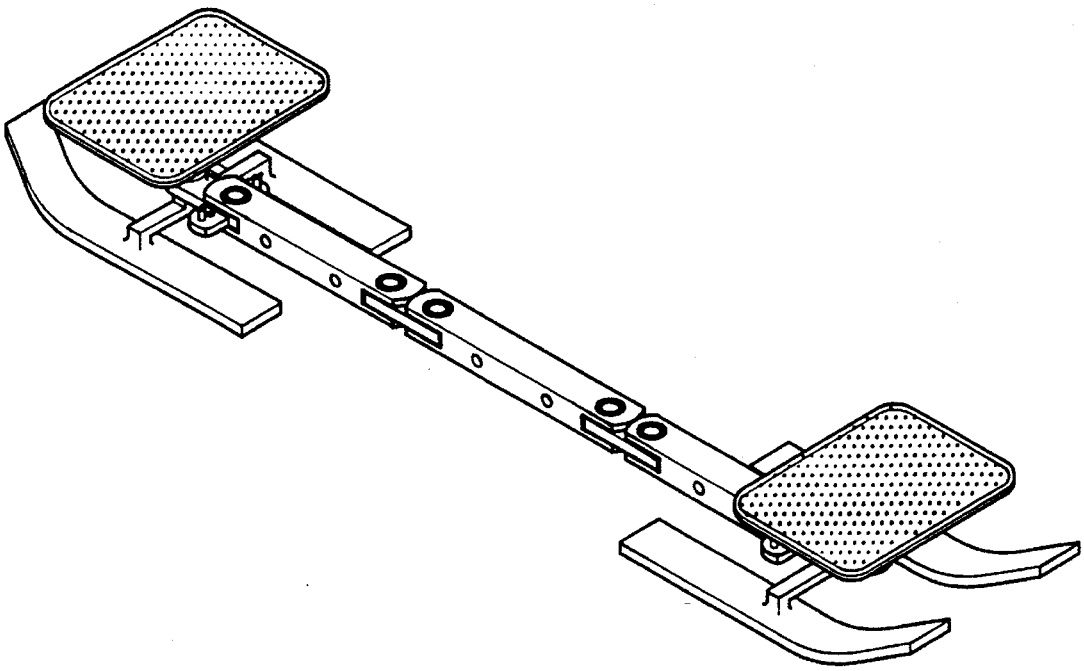
FIG. 7 shows an alternate form of the present invention.

It is to be understood that the drawings are designed for purposes of illustration only, and are not intended as a definition of the limits and scope of the invention disclosed. For example, skis may be used and installed to replate the wheel assemblies (see FIG. 7).

I claim:

1. A folding skateboard comprising a base frame and two wheel assemblies mounted at either end thereof, a foot plate mounted on each wheel assembly, said base frame comprising:

a plurality of frame bars including a pair of end bars and at least one intermediate bar, intermediate link means including a link coupling each end of said intermediate bar to a respective end of one of said end bars for pivotal movement about two points and a link coupling the opposite end of each end bar to a respective wheel assembly for pivotal movement about a single point, said link means further comprising a hole extending through an end portion of each link and respective bar end at the point of pivotal movement and axle bearing means disposed at said point of pivotal movement between an end of a bar and a respective link end portion.

2. The folding skateboard of claim 1 wherein each link connecting said intermediate bar has two opposite ends, each end inserted into an end of a frame bar and two pivot holes at the two opposite ends respectively pivotally connected between the respective axle bearing means , and a pivot pin extending through the hole at each pivot point interconnecting a link and respective bar end.

3. The folding skateboard of claim 1 wherein said link coupling an end of an end bar to each dual wheel assembly comprises a polygonal mounting hole at an end and a vertical barrel passing therethrough fixing a wheel assembly and foot plate to said end, a pivot hole being disposed at an opposite end to the link and one end of the respective frame bar at a respective pivot pin and axle bearing, each end link further housing two opposite side wings, two rows of holes aligned on said side wings, and two stop rods alternatively fastened to the holes on said side wings to limit the turning angle at the respective pivot point.

4. The folding skateboard of claim 1 wherein said frame bars each have a plurality of transverse through holes for permitting said frame bars to be closely connected in parallel by inserting respective pins into the transverse through holes on said frame bars.

* * * * *